US006569040B2

(12) United States Patent
Bradstock

(10) Patent No.: US 6,569,040 B2
(45) Date of Patent: May 27, 2003

(54) GOLF CLUB SELECTION CALCULATOR AND METHOD

(76) Inventor: Alden S. Bradstock, 757 Frederick Rd., Catonsville, MD (US) 21228

( * ) Notice: Subject to any disclaimer, the term of this patent is extended or adjusted under 35 U.S.C. 154(b) by 0 days.

(21) Appl. No.: 09/882,462

(22) Filed: Jun. 15, 2001

(65) Prior Publication Data

US 2002/0038515 A1 Apr. 4, 2002

Related U.S. Application Data

(60) Provisional application No. 60/211,604, filed on Jun. 15, 2000.

(51) Int. Cl.[7] ..... A63B 57/00
(52) U.S. Cl. ..... 473/407; 235/78 G; 235/88 G
(58) Field of Search ..... 473/407; 434/252; 235/88 G, 78 G, 88 R, 78 R

(56) References Cited

U.S. PATENT DOCUMENTS

| | | | | | |
|---|---|---|---|---|---|
| 3,363,836 | A | * | 1/1968 | Lee | 235/88 R |
| 3,744,714 | A | * | 7/1973 | Banner | 235/88 G |
| 4,137,448 | A | * | 1/1979 | Smith | 235/88 G |
| 4,736,093 | A | * | 4/1988 | Braly | 235/88 G |
| 6,296,579 | B1 | * | 10/2001 | Robinson | 473/407 |

* cited by examiner

*Primary Examiner*—Steven Wong

(74) *Attorney, Agent, or Firm*—Law Offices of Royal W. Craig

(57) ABSTRACT

A method of calculating golf club selection, and a calculator for implementing the method. The method involves making an initial club selection based on distance to the target, and then offsetting the initial club selection in accordance with each one of a group of factors including wind direction/speed, slope at the ball, slope at the target, target elevation, and firmness of the ground at the target. The calculator wheel for implementing the method has three overlying disks pivotally attached at the centers for calculating proper club selection based on a variety of club selection factors. The lower disk bears a plurality of radial legends each representing a club selection factor (such as wind direction/speed, slope (lie) at the ball, slope at the target, target elevation, and firmness of the ground at the target), and another legend representing available club options. The central disk has a transparent section with radial indicia for showing through the club selection factor legends on the lower disk, and a window for showing through the available club options. The central disk also has a radial legend representing distance to the target. The upper disk has a first transparent section for showing through the distance to the target legend on the central disk, thereby allowing selection of distance to target. The upper disk also has a second transparent section for showing through the available club options on the lower disk to allow proper club selection. The three disks can be relatively positioned to consistently calculate proper club selection based on all of the necessary club selection factors, thereby giving the golfer confidence in club selection and fostering confidence in shot making.

11 Claims, 6 Drawing Sheets

LEVEL 2: 8 Iron at 140 Yds (128m)

FIG. 1 LEVEL 2: 8 Iron at 140 Yds (128m)

LEVEL 2: 8 Iron at 140 Yds (128m)

LEVEL 2: 8 Iron at 140 Yds (128m)

GOLF CLUB SELECTION CALCULATOR AND METHOD

CROSS-REFERENCED TO RELATED APPLICATIONS

The present application derives priority from U. S. Provisional Patent Application No. 60/211,604 for "GOLF CLUB SELECTION CALCULATOR-WHEEL"; filed: Jun. 15, 2000.

BACKGROUND OF THE INVENTION

1. Field of the Invention

The present invention relates to golf instruments for assistance with one's golf game and, in particular, to a compact and portable calculator-wheel and method of using the same to assist golfers in consistently making the best golf club selection based on primary variables such as distance to the target, wind speed, etc.

2. Description of the Background

Golf proficiency in part depends on the ability to select the optimum club for the shot at hand. If a golfer has been properly taught, good shot making on the course depends more heavily on proper club selection and not the degree of force applied by the swing. The ability to select the best club consistently leads to increased confidence in the swing and a lower all-around score. The only club-selection factor within the golfer's control is the swing force or intensity. By way of example, a golfer can often make a trade-off between a light 7-iron and a heavy 8-iron. Otherwise, there are numerous extrinsic (uncontrollable) factors. The range or distance to the target is the most determinative. By way of example, a golfer might use a four iron for a shot in the 150 to 160 yard range, the five iron in the 140 to 150 yard range, the six iron in the 130 to 140 yard range, and so forth. In addition to distance, there are subtle factors that include at least wind direction and speed, slope (lie) at the ball, slope at the target, target elevation, firmness of the ground at the target, and swing force. Accurate club selection based on these factors and coupled with a "grooved" swing brings far fewer errors and consistently lower scores. Golfers work hard to groove their swings but many are not proficient at evaluating the foregoing factors, or they simply forget one or two. Consequently, their game suffers needlessly.

It would be greatly advantageous to provide a simple and effective device that helps to consistently calculate proper club selection based on all of the foregoing variables, thereby improving a golfer's ability to swing consistently and uniformly by giving him confidence in club selection and fostering confidence in shot making.

SUMMARY OF THE INVENTION

It is therefore an object of the present invention to provide a method of calculating club selection, and a simple and portable calculator therefor that can be used to consistently calculate proper club selection based on all of the necessary considerations including at least distance to the target, wind direction and speed, slope (lie) at the ball, slope at the target, target elevation, firmness of the ground at the target, and swing force.

It is another object to provide a method of calculating club selection and a calculator for implementing the method which relies primarily on the distance to the target and swing intensity, the foregoing being offset by each of the other variables.

It is still another object to make club selection an objective process, thereby giving him confidence in club selection and fostering confidence in shot making.

It is still another object to accomplish the foregoing by a simple means such as a mechanical index wheel that can be carried on the course, needs no batteries, and makes no sound.

These and other objects are accomplished by the provision of a golf accessory for calculating proper club selections. The accessory is a calculator wheel having three overlying disks pivotally attached at the centers. The lower disk bears a plurality of radial legends each representing a club selection factor (such as wind direction/speed, slope (lie) at the ball, slope at the target, target elevation, and firmness of the ground at the target), and another legend representing available club options. The central disk has a transparent section with radial indicia for showing through the club selection factor legends on the lower disk, and a window for showing through the available club options. The central disk also has a radial legend representing distance to the target. The upper disk has a first transparent section for showing through the distance to the target legend on the central disk, thereby allowing rotatable adjustment of the upper disk relative to the central disk to select distance to target. The upper disk also has a second transparent section for showing through the available club options on the lower disk to allow proper club selection. The three disks can be relatively positioned to consistently calculate proper club selection based on all of the necessary club selection factors.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
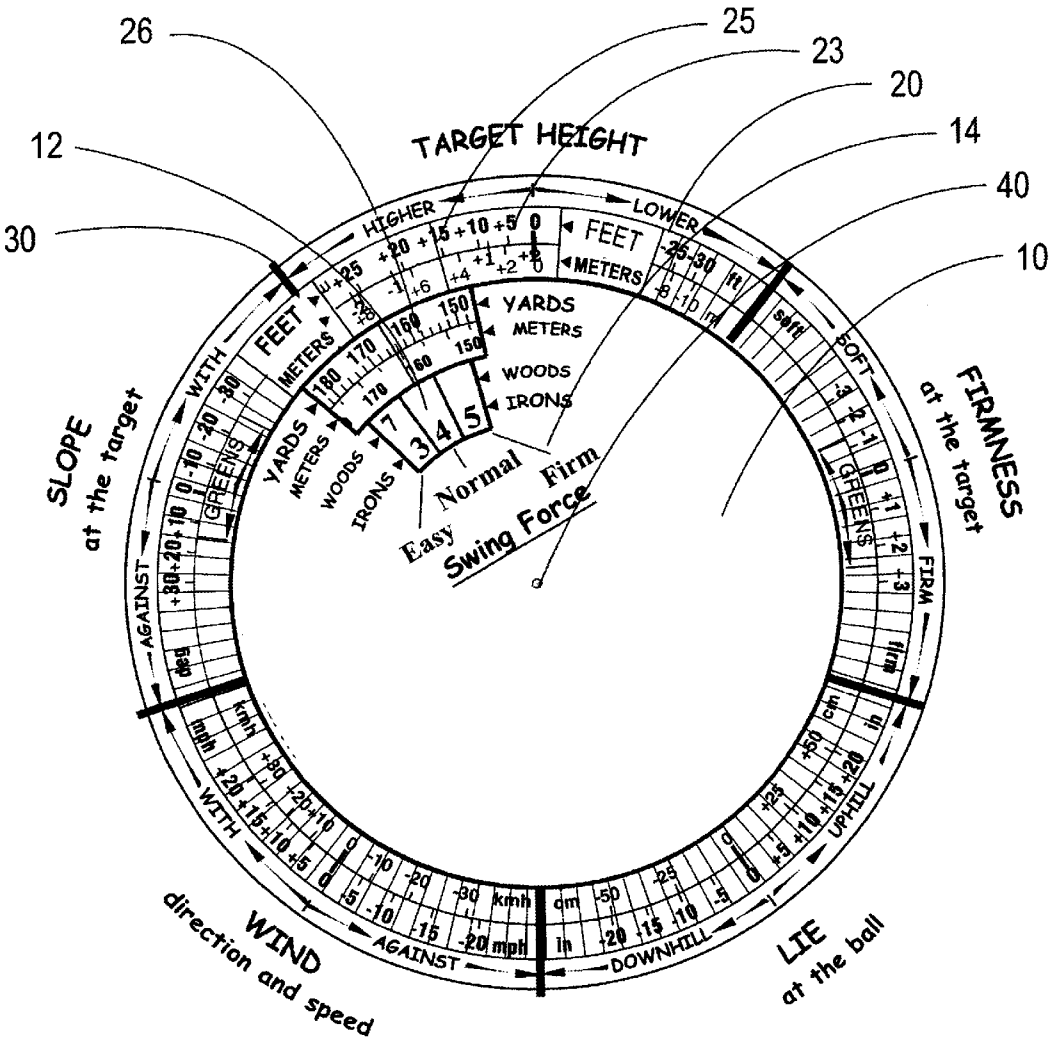
FIG. 1 is a front perspective view of the golf club selection calculator-wheel 2 (inclusive of three overlying disks 10, 20 and 30) according to the present invention.

FIG. 1 is a front perspective view of the golf club selection calculator-wheel 2 according to the present invention. Calculator-wheel 2 generally comprises three overlying disks inclusive of an upper disk 10, central disk 20, and lower disk 30. The disks are joined by a central pivot point 40 and remain free to rotate with respect to each other. All three disks 10, 20 and 30 may be formed from cardstock, plastic or other sheet material, and all are printed with radial legends as shown reflecting the extrinsic shot making factors that affect club selection. These seven factors/legends include: 1) distance to the target; 2) wind direction and speed; 3) slope (lie) at the ball; 4) slope at the target; 5) target elevation; 6) firmness of the ground at the target; and 7)

swing force. The illustrated radial legends are representative of those suitable for experienced golfers capable of hitting an 8 iron 140 yards. In practice, club selection also depends on swing speed. Thus, the printing scales will vary for more or less powerful golfers, and the radial legends must reflect ability. This is accomplished by providing different models of the calculator 2, each being suited for a particular level of golfer. It is envisioned that five levels (1–5) will adequately cover all abilities, and the illustrated embodiment (for golfers capable of hitting an 8 iron 140 yards) would then be a "Level 2". Golfers capable of hitting an 8 iron 150 yards might purchase a "Level 1", and so on.

Each legend is partially viewable through a window in the overlying disk, and the windows are defined by hairlines to allow precise selection of specific values simply by dialing the disks. This way, a golfer can dial the respective disks 10 and 20 to input the estimated values for each shot. The calculator-wheel 2 automatically calculates the options for proper club selection, giving a range of choices dependent on swing force or intensity.

Figure 2:
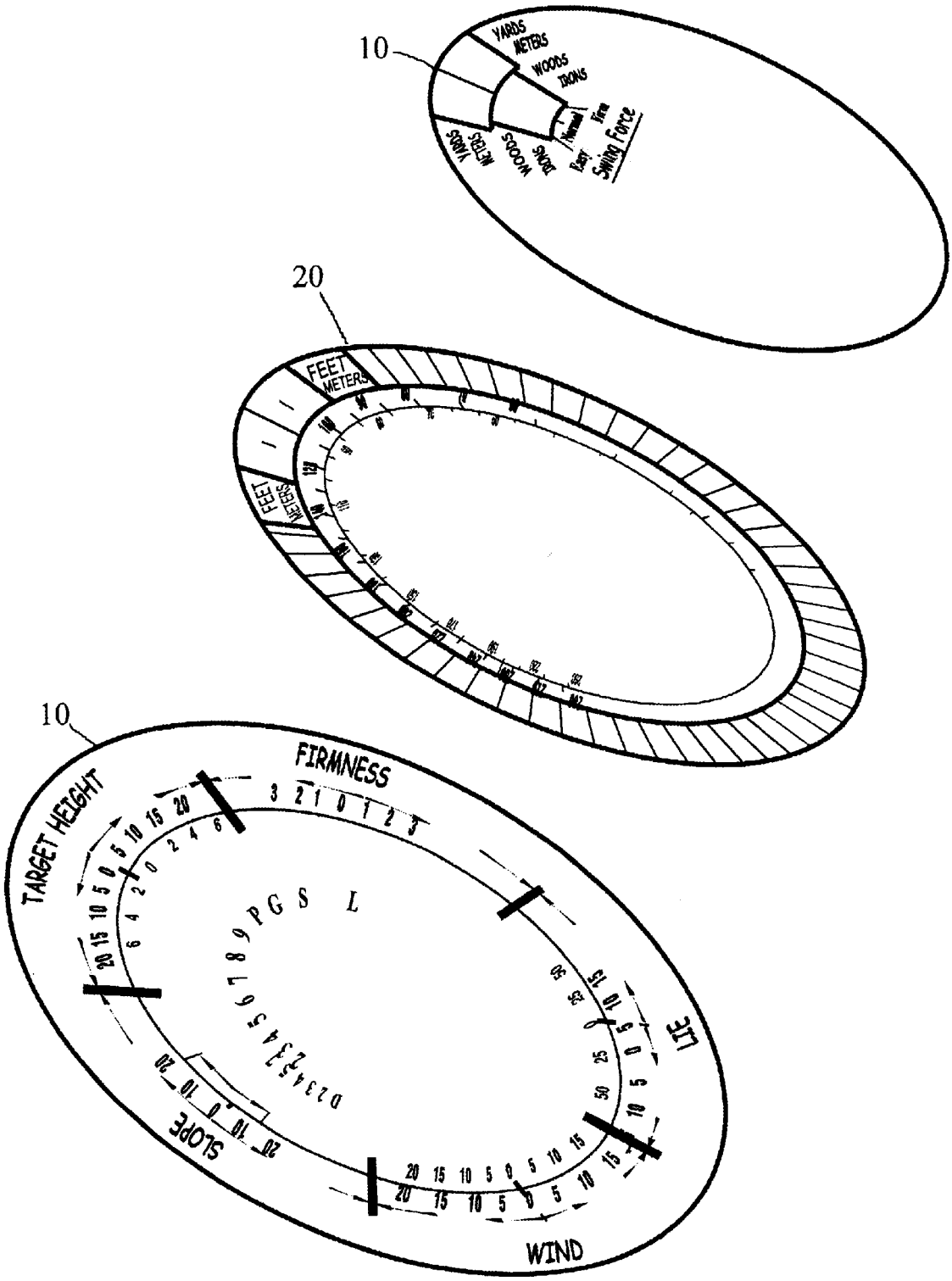
FIG. 2 is an exploded perspective view of the golf club selection calculator-wheel 2 as in FIG. 1.

FIG. 2 is an exploded perspective view of the golf club selection calculator-wheel 2 as in FIG. 1 showing the three overlying disks including upper disk 10, central disk 20, and lower disk 30. The three disks 10, 20, and 30 may be attached together using a simple rivet or eyelet.

Figure 3:
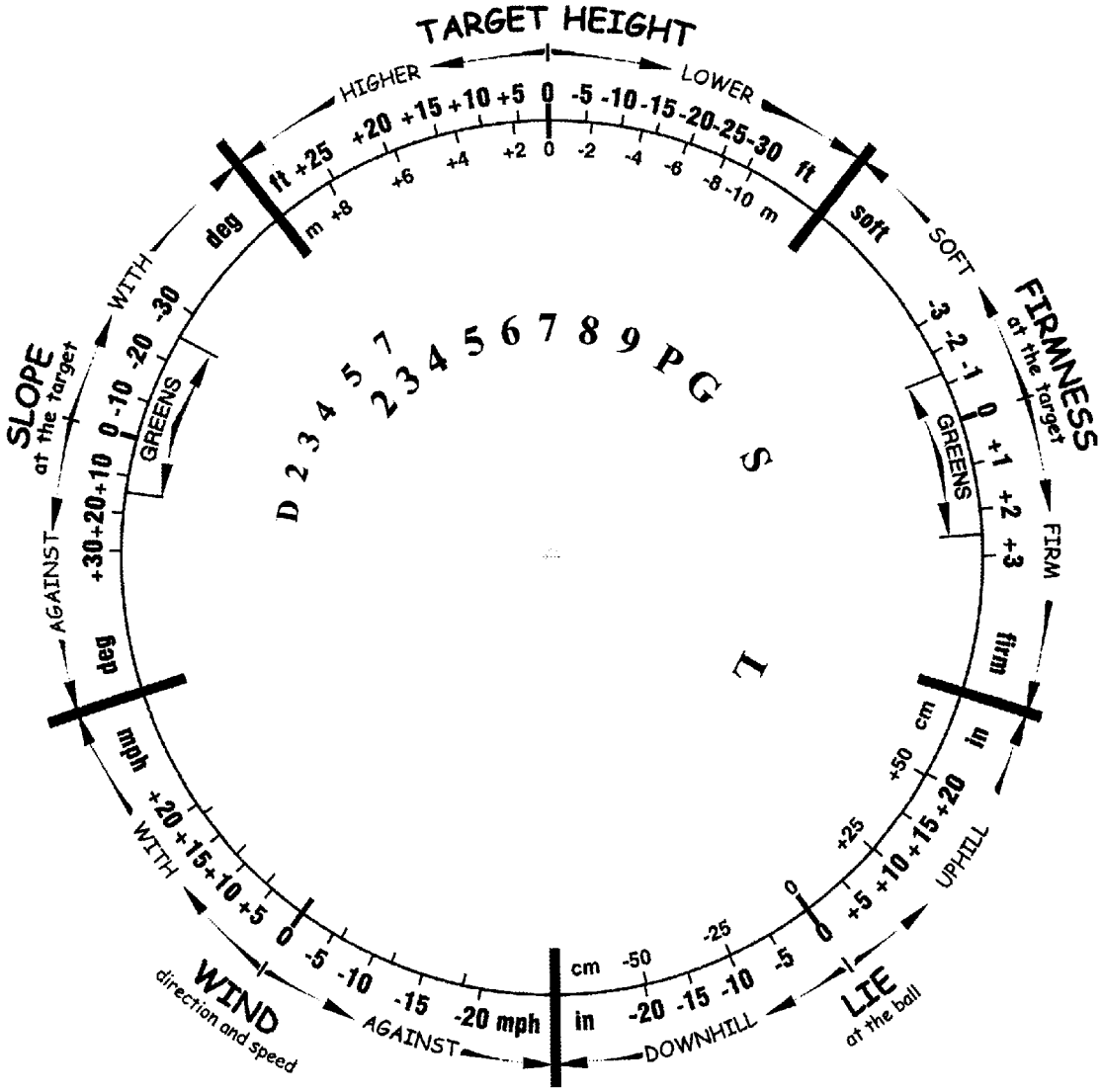
FIG. 3 is a close-up front perspective view of the lower disk 30 employed by the calculator-wheel 2 of FIG. 1.

FIG. 3 is a close-up front perspective view of the lower disk 30 employed by the calculator-wheel 2 of FIG. 1. The lower disk 30 bears a series of radial legends representing five of the variables, inclusive of factors 2–6 above (wind direction and speed, slope (lie) at the ball, slope at the target, target elevation, and firmness of the ground at the target). The radial legends on lower disk 30 each occupy 36 degrees of the circumference of the disk 30, thereby collectively circling the entire disk 30. Each legend on lower disk 30 represents a range of "offset" values having a minimum offset of zero, and both positive and negative maximum offsets. Specifically, the wind direction and speed ranges from +20 to −20 mph (preferably also shown split-scale in metric); slope (lie) at the ball ranges from +20 to −20 inches (+50 to −50 cm metric), slope at the target ranges from +30 to −30 degrees, target height/elevation ranges from +25 feet to −30 feet (also in metric), and firmness of the ground at the target ranges from +3 (most firm or hard) to −3 (least firm or soft). As will be seen, a portion of each of the five radial legends can be viewed through a corresponding window in the central disk 20, thereby allowing the golfer to offset the proper club selection based on each of the five factors.

The lower disk 30 also bears a radial legend (more centrally) that reflects the sequential club choices, for example, 3 iron through 9 iron, plus pitching, sand and lob wedges. Just outside this, the choices driver through 7 wood are listed as shown and generally correspond to the iron choices (e.g., a 7 wood is roughly equivalent to a soft 4 iron). These legends appear through the window 12 in the upper disk 10.

Figure 4:
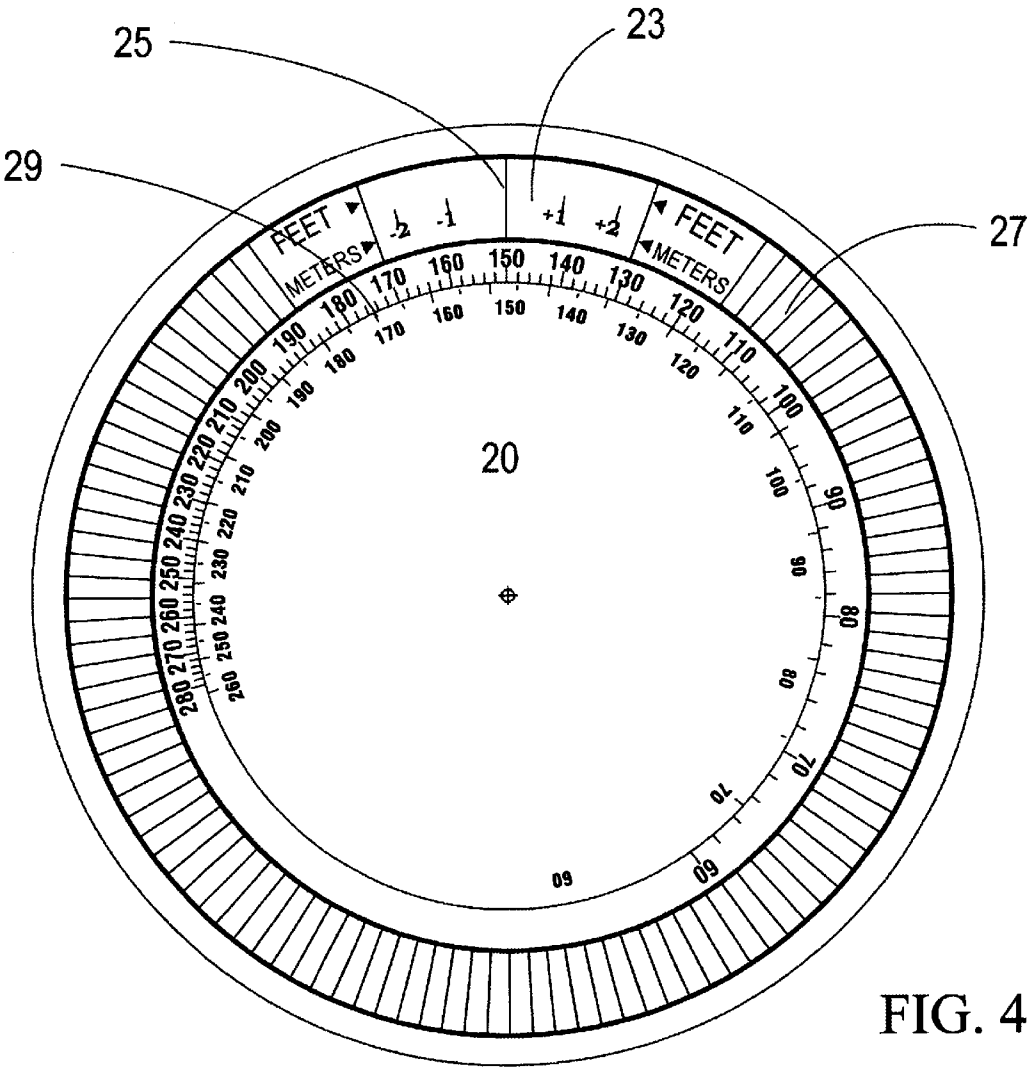
FIG. 4 is a close-up front perspective view of the central disk 20 employed by the calculator-wheel 2 of FIG. 1.

FIG. 4 is a close-up front perspective view of the central disk 20 employed by the calculator-wheel 2 of FIG. 1. The central disk 20 is preferably a transparent disk printed to leave a window 23 with hairline 25 as shown. The window 23 allows the target height legend of the lower disk 30 to show through, the specific target height value being selectable with the hairline 25. The window is appropriately labeled feet and meters to reflect the U.S. metric dual-scale. The remainder of the periphery of central disk 20 is defined by a scale of transparent or translucent indicia 27. The translucent periphery 27 allows the remaining four legends of the lower disk 30 to show through. Once the target height is selected, the specific values of wind direction and speed, slope (lie) at the ball, slope at the target, and firmness of the ground at the target are dialed as off-sets by adjusting the respective scales on the lower disk 30 with respect to the translucent indicia 27 on the center disk 20 as will be described. Outside the sequential club choices, a distance legend 29 appears on disk 20 and this is a dual (US/metric) radial scale reflecting the distance to the target as measured in yards and/or meters. This distance legend 29 on central disk 20 shows through the window 16 in the upper disk 10. A hairline 17 is printed on the window 16 thereby allowing the golfer to dial in the appropriate distance to the target (yards and/or meters). It should be noted that the sequential club choice scale and distance legend are both on central disk 20 and are fixed with respect to each other.

Figure 5:
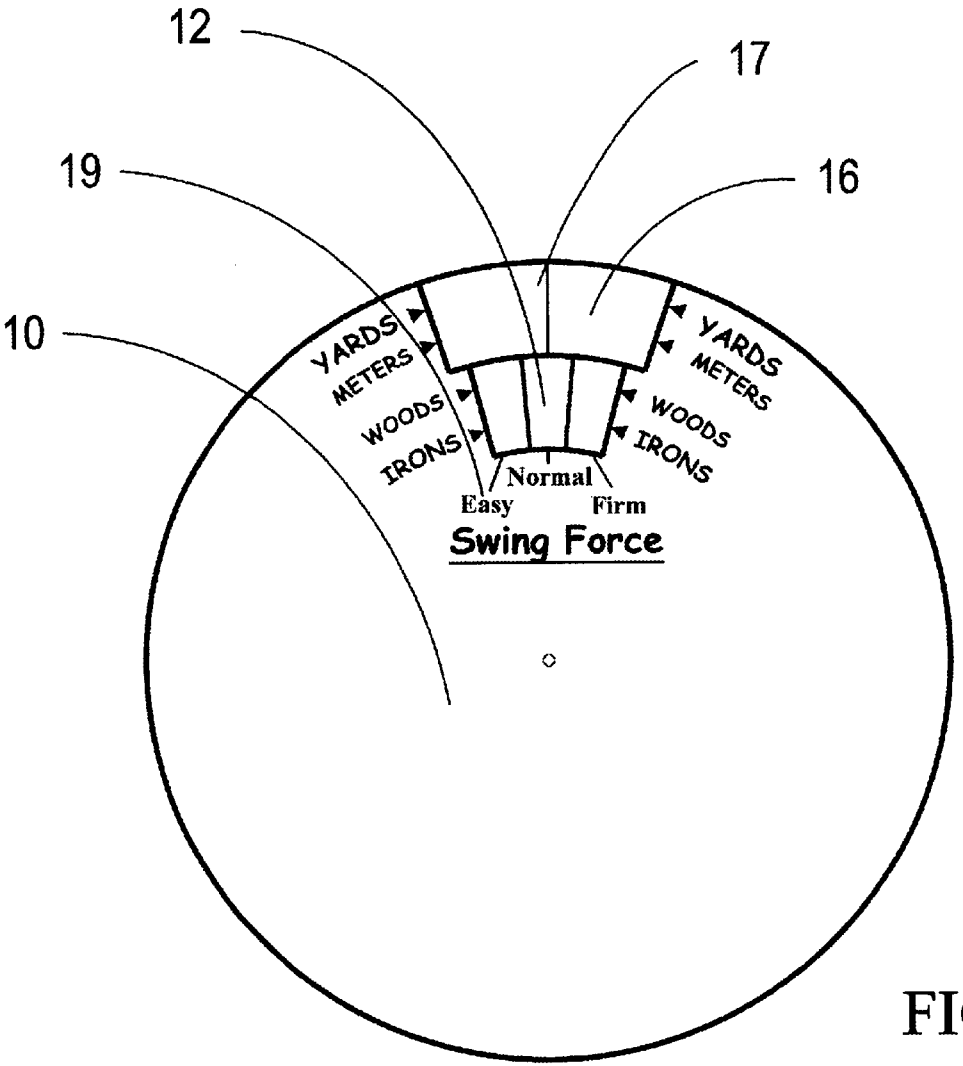
FIG. 5 is a close-up front perspective view of the upper disk 10 employed by the calculator-wheel 2 of FIG. 1.

FIG. 5 is a close-up front perspective view of the upper disk 10 employed by the calculator-wheel 2 of FIG. 1. The upper disk 10 is preferably a transparent disk printed to leave windows 12 and 16, respectively. Alternatively, the windows 12, 16 can be formed by transparent inserts bonded across cut-outs in cardstock sheet material. As described above, window 16 includes a hairline 17 printed thereon and allows the distance to the target scale on the central disk 20 to show through, thereby allowing the golfer to dial in the appropriate distance (yards and/or meters). Window 12 is axially subdivided into three smaller windows as shown thereby allowing three corresponding iron selections and wood selections from the lower disk 30 to show through. Window 12 is radially subdivided and labeled as shown to designated either wood and iron choices. Inside of the club choice window 12, the upper disk 10 bears the swing force legend "Easy", "Normal" and "Firm" at 19. In this manner, the target distance on central disk 20 is dialed in at window 16, and then window 12 shows the result of the calculation from the swing force legend on the lower disk 30, indicating to the golfer the proper club choice options (iron and/or wood) according to swing force (normal, easy or firm).

By properly positioning all three disks in the manner to be described, the golfer is shown the most appropriate club selections through window 12 inclusive of whether the respective clubs should be hit "Easy", "Normal" or "Firm" 19.

The operation of the golf club selection calculator-wheel 2 as shown in all of FIGS. 1–4 will now be described.

Initially, the golfer adjusts the central disk 20 to determine the offsets or adjustments to distance to the target. This initially entails setting the Target Height by adjusting the central disk 20 until the center hairline 25 on the Target Height window 23 of central disk 20 is centered over the difference in height (elevation) between the ball and the target as indicated along the target height scale on the lower disk 30. For example, the golfer would place the hairline 25 on the Target Height window 23 of central disk 20 over the −10 (−2.9) index if the target is 10 feet (2.9 meters) below the elevation of the ball.

Next, the golfer sets the slope (lie) at the ball. This is done by locating the hairline of the translucent indicia 27 on the central disk 20 that is closest to the zero index of the Slope (lie) at the Ball scale on the lower disk 30. The golfer should then rotate the central disk 20 until the zero index along the Slope (lie) at the Ball scale on the lower disk 30 is centered on the difference in height (elevation) of the ground under the golfer's feet when they address the ball. For example, if the foot closest to the target is 10 inches (24 centimeters) below the foot furthest from the target when the golfer stands at the ball, place the hairline over the −10 (24) index. Note that the prior correction for target height will change.

Next, the golfer sets the Slope at the Target. This is done by locating the hairline of translucent indicia 27 on the center disk 20 that is closest to the zero index along the "Slope at the Target" scale on the lower disk 30. The central disk 20 is then rotated until the zero index along the Slope at the Target scale on the lower disk 30 is centered on the estimated slope to the target. For example, if the ground slopes downhill at a 30 degree angle at the target, the hairline of translucent indicia 27 on the center disk 20 is centered over the 30 index along the Slope at the Target scale. As before, note that the prior correction for target height and for slope at the ball will change.

Next, the golfer sets the Firmness at the Target. This is done by locating the hairline of translucent indicia 27 on the center disk 20 that is closest to the zero index along the "Firmness at the Target" scale on the lower disk 30. The central disk 20 is then rotated until the zero index along the Firmness at the Target scale on the lower disk 30 is centered on the relative firmness at target. For example, if the ground is very firm at the target, place the hairline over the +3 index. Once again, the previous corrections will change.

Finally, the golfer sets the Wind Speed and Direction. This is done by locating the hairline of translucent indicia 27 on the center disk 20 that is closest to the zero index along the "Wind Speed and Direction" scale on the lower disk 30. The center disk 20 is then rotated until the zero index along the Wind Speed and Direction scale on the lower disk 30 is centered on the estimated or measured wind speed. For example, if the windspeed is 12 mph (or 20 km/hr) directly into the golfer's face, the central disk 20 should be rotated until the Wind Speed and Direction hairline is centered on −12/−20 along the scale on the lower disk 30. As before, note that the prior corrections will change.

After the golfer has adjusted the lower disk 30, the upper disk 10 is adjusted to finalize the proper club selection options for the particular shot:

First, the upper disk 10 should be rotated until the hairline 17 is directly over the estimated distance (from scale 29 on center disk 20) to the point where the golfer wishes the ball to come to rest.

Second, depending on the swing force for the shot (easy, normal and firm), as many as six proper iron or wood club options are shown in window 12. The golfer may decide whether to hit the ball with a Normal, Easy or Firm swing (in that order) as indicated in the subdivided SWING FORCE window 12 and make the club choice accordingly.

It should be noted that the legends printed on the above-described disks 10, 20 and 30 are representative of experienced golfers capable of hitting an 8 iron 140 yards. The printing scales will vary for less experienced or powerful golfers.

The foregoing calculator-wheel 2 provides a simple and portable calculator that can be used to consistently calculate proper club selection based on all of the necessary considerations including distance to the target, wind direction and speed, slope (lie) at the ball and slope at the target, target elevation, firmness of the ground at the target, and swing force. Club selection becomes an objective decision, thereby giving the golfer confidence in club selection and fostering confidence in shot making.

Figure 6:
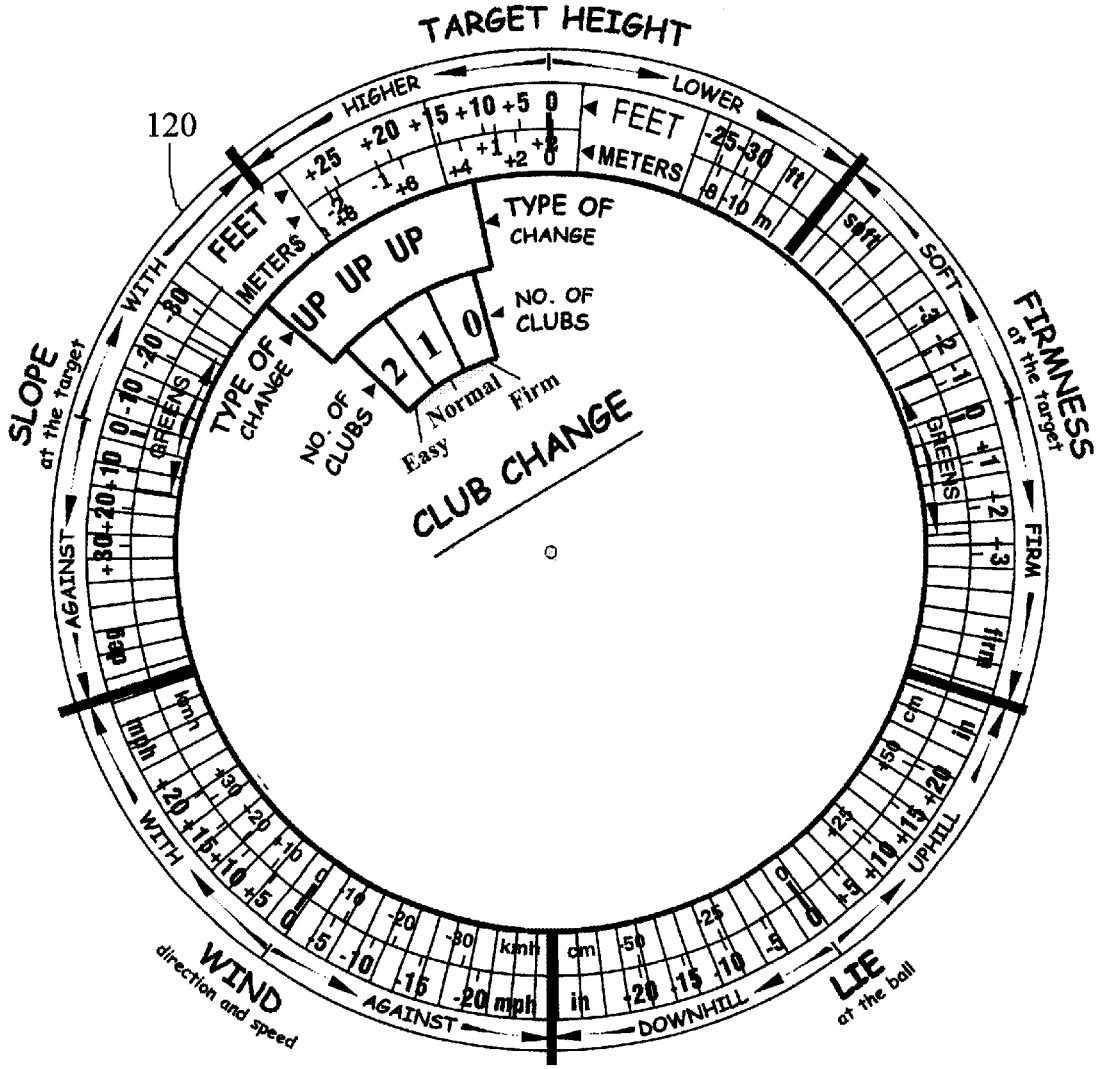
FIG. 6 is a front perspective view of a golf club selection calculator-wheel 120 (inclusive of three overlying disks) which provides a relative club recommendation rather than an absolute club selection as in the calculator-wheel 2 of FIG. 1.

FIG. 6 is a front perspective view of a golf club selection calculator-wheel 120 (inclusive of two overlying disks) which provides a relative club recommendation rather than an absolute club selection as in the calculator-wheel 2 of FIG. 1. Most all of the radial legends and indicia on the previously-described disks remain the same. The difference is that disks 10 and 20 are combined, and the club selection legend 135 of disk 30 becomes a relative club recommendation rather than an absolute club selection, indicating the "type of change" from the normal club selection the golfer would make in a particular situation. The type of change is suggested by "Up", "Down" or No Change". In combining disks 10 and 20, the Distance to the Target radial legend 29 of FIGS. 1 and 4 is eliminated. The words "Up" or "Down" are printed in its place on the combined disk. The club number radial legend of FIG. 3 is likewise replaced by the digits 0–5, which are printed on the combined disk. The operation of the embodiment of FIG. 6 is largely the same except that there are only two disks. The golfer makes his normal club selection for a particular shot and then uses the wheel to offset the selection based on five factors/legends including: 1) wind direction and speed; 2) slope (lie) at the ball; 3) slope at the target; 4) target elevation; and 5) firmness of the ground at the target. The suggested offset is displayed in the type of change window as "Up" or "Down", and the number of club adjustments 0–5 to make (either up or down) is displayed directly beneath.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

I claim:

1. A golf accessory for calculating proper club selections, comprising three overlying disks pivotally centrally and rotatably attached and including:

a lower disk bearing a radial legend representing at least one club selection factor selected from a group consisting of wind direction/speed, slope (lie) at the ball, slope at the target, and firmness of the ground at the target;

a central disk having a window for displaying a portion of the legend on said lower disk, said central disk also having a radial legend representing distances to the target;

an upper disk having a second window for displaying a portion of the legend on said central disk.

2. The golf accessory for calculating proper club selections according to claim 1, wherein said lower disk bears a second radial legend representing available club options.

3. The golf accessory for calculating proper club selections according to claim 1, wherein said at least one club selection factor on said lower disk is wind direction/speed.

4. The golf accessory for calculating proper club selections according to claim 1, wherein said at least one club selection factor on said lower disk is slope at the ball.

5. The golf accessory for calculating proper club selections according to claim 1, wherein said at least one club selection factor on said lower disk is slope at the target.

6. The golf accessory for calculating proper club selections according to claim 1, wherein said at least one club selection factor on said lower disk is firmness of the ground at the target.

7. The golf accessory for calculating proper club selections according to claim 2, wherein said central disk window shows through the available club options.

8. A golf accessory for calculating proper club selections, comprising three overlying disks pivotally attached at the centers and including:

a lower disk bearing a plurality of radial legends each representing a club selection factor selected from a group consisting of wind direction/speed, slope (lie) at the ball, slope at the target, and firmness of the ground at the target, and a legend representing available club options;

a central disk having a transparent section with indicia for showing through the plurality of radial legends a club selection factor on the lower disk as well as the available club options, and for allowing rotatable adjustment of the lower disk relative to the central disk, said central disk also having a radial legend representing distance to the target;

an upper disk having a first transparent section for showing through the distance to the target legend on the central disk, thereby allowing rotatable adjustment of the upper disk relative to the central disks to select distance to target, and further having a second transparent section for showing through the available club options on the lower disk to allow proper club selection.

9. A method for selecting a golf club for a particular shot, comprising the steps of:

calculating a club selection offset in accordance with each one of a group of factors consisting of wind direction/speed, slope (lie) at the ball, slope at the target, target elevation, and firmness of the ground at the target;

calculating a club selection based on distance to the target and relative to said club selection offset; and indicating said club selection.

10. The method for selecting a golf club for a particular shot according to claim 9, wherein said steps of calculating a club selection offset and calculating a club selection are both accomplished by dialing overlying disks of a calculator wheel.

11. The method for selecting a golf club for a particular shot according to claim 9, wherein said step of calculating a club selection offset further comprises calculating a number of upward or downward club adjustments based on said factors, and said step of indicating a corrected club selection further comprises displaying said club adjustment to the golfer.

* * * * *